United States Patent [19]

Yasuhara

[11] 4,397,280

[45] Aug. 9, 1983

[54] GOVERNOR MECHANISM FOR A DISTRIBUTOR-TYPE FUEL INJECTION PUMP

[75] Inventor: Seishi Yasuhara, Yokosuka, Japan

[73] Assignee: Nissan Motor Co., Ltd., Yokohama, Japan

[21] Appl. No.: 150,528

[22] Filed: May 16, 1980

[30] Foreign Application Priority Data

May 21, 1979 [JP] Japan ..... 54-66801[U]

[51] Int. Cl.[3] ..... F02D 1/04; F02D 1/06

[52] U.S. Cl. ..... 123/449; 123/370; 123/379; 123/363; 123/372; 123/373

[58] Field of Search ..... 123/449, 372, 373, 370, 123/363, 379

[56] References Cited

U.S. PATENT DOCUMENTS

| | | | |
|---|---|---|---|
| 3,848,576 | 11/1979 | Hofer | 123/449 |
| 4,271,808 | 6/1981 | Kobayashi | 123/449 |
| 4,284,047 | 8/1981 | Stumpp | 123/449 |

*Primary Examiner*—Ronald B. Cox

*Attorney, Agent, or Firm*—Thompson, Birch, Gauthier & Samuels

[57] ABSTRACT

A governor sleeve is axially displaceable on a stationary governor shaft and has an inner space which is defined by one end of the governor shaft and which communicates with the inner chamber of a pump housing charged with fuel. The inner space varies in volume drawing thereinto and discharging therefrom fuel in response to axial displacement of the governor sleeve. There are provided, according to the invention, first channel means for providing restricted communication between the inner chamber and the inner space, second channel means for providing substantially unrestricted communication between the inner chamber and the inner space, and valve means operable to allow only said first channel means to establish the above-mentioned restricted communication upon displacement of the governor sleeve in the direction to produce contraction of the inner space and to allow at least the second channel means to establish the substantially unrestricted communication upon displacement of the governor sleeve in the direction to produce expansion of the inner space in order to prevent an acceleration jerk and smoky exhaust.

9 Claims, 10 Drawing Figures

GOVERNOR MECHANISM FOR A DISTRIBUTOR-TYPE FUEL INJECTION PUMP

BACKGROUND OF THE INVENTION

This invention relates in general to distributor-type fuel injection pumps for compression ignition internal combustion engines or Diesel engines and more particularly to governors of such fuel injection pumps.

In FIG. 1, there is shown a prior art distributor-type fuel injection pump for a compression ignition multicylinder internal combustion engine.

The prior art distributor-type fuel injection pump comprises a pump housing 1 having an inner chamber 1*a* which is charged with fuel by a fuel supply pump (not shown). To the pump housing 1 there is fixedly attached a plunger barrel 2 in which is mounted a distributor plunger 3. The distributor plunger 3 is powered by engine-driven power transmitting means (not shown) and reciprocates while rotating to effect pumping and distributing actions.

During the suction stroke or leftward stroke of the distributor plunger 3, fuel is drawn from the inner chamber 1*a* through an inlet channel 4 and longitudinal grooves 5 provided in the outer face of a terminal portion of the distributor plunger 3 to a pump work chamber 6 which is adjoined by the distributor plunger 3. During the pressure stroke or rightward stroke of the distributor plunger 3, fuel under pressure is delivered from the pump work chamber 6 through a distributor channel 7 to one of outlet channels (only one is shown). Therefrom fuel is delivered through the associated one of delivery valves 9 to one of injection nozzles (not shown). In this manner, fuel is sequentially injected into the cylinders of the engine.

In the distributor plunger 3 there is provided a transverse channel or relief channel 10 which cooperates with a control sleeve 11. The control sleeve 11 is axially displaceable on the distributor plunger 3 to seal and unseal the mouths of the relief channel 10 in the outer surface of the distributor plunger 3. When the control sleeve 11 unseals or uncovers the mouths of the relief channel 10, the pump work chamber 6 is drained into the inner chamber 1*a* if the pump housing 1 to terminate the fuel delivery to the injection nozzles. Hence it is possible to alter the terminal moment of fuel delivery during each pressure stroke of the distributor plunger 3 and therefore the quantity of fuel delivered to the engine by changing the position of the control sleeve 11. For example, leftward displacement of the control sleeve 11 in the drawing results in reduced injected fuel quantity.

The axial position of the control sleeve 11 is controlled by a governor mechanism which comprises a governor shaft 12 which is fixedly attached to the pump housing 1. On the governor shaft 12 there is rotatably mounted a centrifugal weight holder 13. The holder 13 is powered by the aforementioned power transmitting means (not shown) for the distributor plunger 3 by way of a multiplying gear (also not shown). On the centrifugal weight holder 13, centrifugal weights 14 are supported and rotated about the governor shaft 12 and swing outwardly due to centrifugal force. As the weights swing outwardly, fingers 14*a* axially displace a governor sleeve 15 on the governor shaft 12, in the rightward direction in the drawing. The governor sleeve 15 abuttingly engages at the left-hand end thereof with the upper arm portion of a starting lever 16 which is swingably supported on a pivot 17. The lower arm portion of the starting lever 16 has a spherical terminus 16*a* which extends into a depression of the control sleeve 11 for causing axial displacement of the control sleeve. On the pivot 17 there is also swingably supported a tensioning lever 18. Between the tensioning lever 18 and the starting lever 16 there is interposed a starting spring or an excess fuel spring 19 in the form of a leaf spring. The tensioning lever 18 is operatively connected through an idle spring 20, a governor main spring 21 and a control lever 22 to an accelerator pedal (not shown). Stopper 23 limits the extent of counterclockwise swing of the tension lever 18.

The operation of the governor mechanism thus described will be explained hereinbelow with additional reference to FIG. 2.

When the engine is stopped and therefore the centrifugal weights 14, are motionless the centrifugal weights 14 assume the completely closed condition due to the bias of the starting spring 19 transmitted thereto by way of the starting lever 16 and at the same time control sleeve 11 is moved into the starting position or the most rightward position thereof (represented by the horizontal line A in the graph of FIG. 2) in the drawing (FIG. 1) whereby an excess fuel quantity required by the engine during starting is obtained.

When the engine starts and in the absence of depression on the accelerator pedal, the control lever 22 is put into the idle position and therefore the tension of the governor spring 21 reduces approximately to zero. The centrifugal weights 14 are thus permitted to swing outwardly even in the relatively low rotational conditions thereof which displaces the governor sleeve 15 rightwardly turning the starting lever 16 together with the tension lever 18 and compressing both the starting spring 19 and the idle spring 20, resulting in the movement of the control sleeve 11 leftwardly into the idle position which is determined by the balance of the centrifugal force and the biasing forces of the starting spring 19 and the idle spring 20. In this manner, the quantity of fuel necessary for smooth idling of the engine is obtained as represented by the point B in the graph of FIG. 2.

When the accelerator pedal is then depressed to move the control lever 22 to some extent, the tension of the governor main spring 21 becomes larger and consequently both the starting spring 19 and the idle spring 20 are compressed to be of shorter length permitting the tension lever 18 to swing counterclockwise until it abuttingly engages the stopper 23. Actuated by such swing of the tension lever 18, the starting lever 16 displaces the control sleeve 11 to the full load position as is represented by the point C in the graph of FIG. 2. The control sleeve 11 remains thereat permitting the engine speed to increase up to the value as is represented by the point D in the graph of FIG. 2 where the centrifugal weights 14 start to displace the governor sleeve 15 overcoming the counter force thereto. After that, the control sleeve 11 is displaced in the fuel-increasing direction, i.e., leftwardly to the position as represented by the point E in the graph of FIG. 2 which is determined by the balance of the centrifugal force of the centrifugal weights 14 and the biasing forces of the springs 19, 20 and 21. The engine speed is thus controlled with relation to the amount of depression on the accelerator pedal.

The pivot 17 is carried on a full load fuel quantity adjusting lever 24 which is pivotally supported on a stationary pivot 25. The adjusting lever 24 is normally held stationary but is caused to swing about the stationary pivot 25 by rotating a screw 26 to change the setting of the full load fuel quantity. A fuel-cut solenoid valve 27 is provided for stopping the engine.

The governor sleeve 15 has an inner space 30 which is adjoined by an end of the governor shaft 12 and which varies in volume in response to axial displacement of the governor sleeve on the governor shaft. In order to draw fuel from the inner chamber 1*a* of the pump housing 1 into the inner space 30 and on the other hand to discharge fuel from the inner space 30 into the inner chamber 1*a* in response to the variation in volume of the inner space 30, there is provided in the governor sleeve 15 an opening P which provides communication between the inner space 30 and the inner chamber 1*a*. The flow passage sectional area of the opening P has heretofore been designated to be relatively large for the reason of good responsiveness.

Though the prior art distributor-type fuel injection pump with such a governor mechanism produces good results upon engine deceleration due to the good responsiveness, it tends to produce undesirable results upon rapid engine acceleration due to the good responsiveness. That is, upon rapid engine acceleration, the control lever 22 actuates, by means of the governor main spring 21, the starting lever 16 together with the tension lever 18 to rapidly swing in the counterclockwise direction displacing the governor sleeve 15 leftwardly in the drawing. In response to such displacement of the governor sleeve 15, the control sleeve 11 is rapidly displaced rightwardly or in the fuel-increasing direction. As a result, the quantity of fuel delivered to the engine increases rapidly, resulting in an acceleration jerk which prevents good drivability and causes a smoky exhaust emission from the engine. This occurs because, at the initial stage of the rapid engine acceleration, the rate of engine air flow can not quickly increase so as to match the increased quantity of fuel delivered to the engine, that is, the increase in the rate of engine air flow lags behind the increase in the quantity of fuel delivered to the engine.

OBJECTS OF THE INVENTION

It is accordingly an object of the present invention to provide a distributor-type fuel injection pump with an improved governor mechanism which is free from the foregoing drawbacks inherent in the prior art comparable fuel injection pump.

It is another object of the present invention to provide a distributor-type fuel injection pump of the above described character which is constructed to prevent an acceleration jerk upon rapid engine acceleration.

It is a further object of the present invention to provide a distributor-type fuel injection pump of the above described character which is constructed to prevent smoky exhaust emission from a Diesel engine upon rapid engine acceleration.

It is a yet a further object of the present invention to provide a distributor-type fuel injection pump of the above described character which is constructed to prevent noxious exhaust emissions from the engine upon rapid engine acceleration.

BRIEF DESCRIPTION OF THE DRAWINGS

The features and advantages of the present invention will become more apparent from the following description taken in conjunction with the accompanying drawings, in which like reference numeral designate like parts throughout the several views and in which.

DESCRIPTION OF THE PREFERRED EMBODIMENTS

Figure 3A:
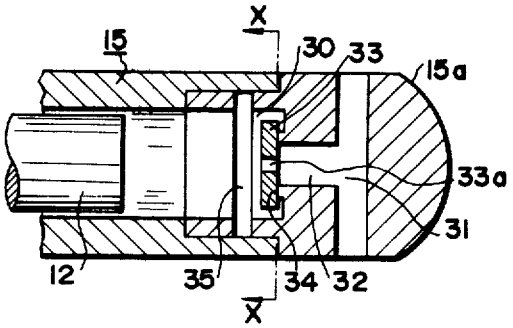
FIG. 3A is a fragmentary sectional view showing part of a governor mechanism of a distributor-type fuel injection pump embodying the present invention.
Figure 3B:
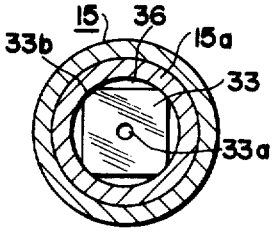
FIG. 3B is a cross sectional view taken approximately along line X—X of FIG. 3A.

Referring to FIGS. 3A and 3B, part of a governor mechanism of a distributor-type fuel injection pump embodying the present invention is shown. The omitted part of the governor mechanism is substantially similar to the prior art fuel injection pump of FIG. 1. FIG. 3A shows governor shaft 12, governor sleeve 15, and inner space 30 defined by the end of governor shaft 12.

The end portion of the governor sleeve 15 is formed into a separate cap 15*a* which is press fit assembled or otherwise fixedly attached to the governor sleeve proper. The cap 15*a* is formed with a transverse channel 31 which opens at the opposite ends thereof into the inner chamber 1*a* of the pump housing 1 and an axial channel 32 which extends from the transverse channel 31 to the inner space 30 of the governor sleeve 15. The cap 15*a* is also formed with a valve seat 34 in the form of an annular projection around the mouth of the axial channel 32 opening into the inner space 30. Within the inner space 30 there is disposed a valve element 33 in the form of a thin, flat, square plate a central orifice or opening 33*a*. The opening 33*a* has a relatively small flow passage cross sectional area as compared with that of the channels 31 and 32. As shown in FIG. 3B, the valve element 33 has chamfered corners at which it is fittingly and slidably engaged with the inner cylindrical wall of the cap 15*a* constituting part of the inner space defining wall of the governor sleeve 15. The valve element 33 is movable toward and away from the valve seat 34 and the extent of its movement away from the latter is limited by a transverse pin 35 attached to the cap 15*a*.

The valve element 33 is preferably made of such a material as to be light in weight and durable, for example, made of synthetic resin such as nylon or Teflon (trade name) or made of metal such as aluminum.

The periphery of the valve element 33 cooperates with the above mentioned inner cylindrical wall of the cap 15*a* to define therebetween four segment-shaped openings 36. The opening 33*a* of the valve element 33 is designed to be of a flow passage cross sectional area which is sufficiently or suitably smaller than the sum of the flow passage cross sectional areas of the four segment-shaped openings 36 such that a desired response characteristic of the governor mechanism is obtained.

Figure 1:
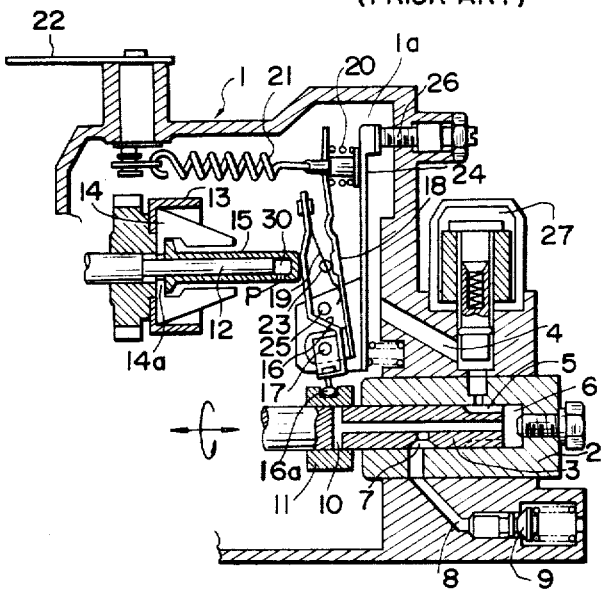
FIG. 1 (PRIOR ART)
FIG. 1 is a sectional view partly broken away showing a prior art distributor-type fuel injection pump with which the present invention is concerned.
Figure 2:
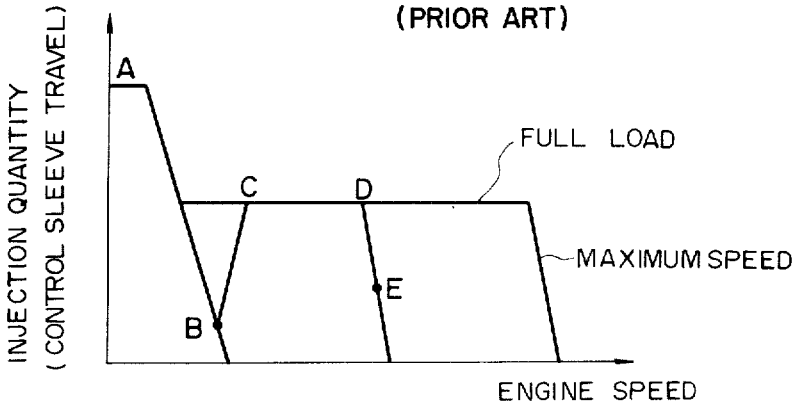
FIG. 2 (PRIOR ART)
FIG. 2 is a graph showing the operation characteristics of the governor mechanism of the fuel injection pump of FIG. 1.

The operation of the distributor-type fuel injection pump with an improved governor mechanism thus described according to the present invention will be explained hereinbelow with additional reference to FIG. 1.

Upon engine acceleration, the governor sleeve 15 is actuated by the tension lever 18 and the starting lever 16 to be displaced leftwardly in the drawing. In this instance, as the governor sleeve 15 is increasingly displaced in the leftward direction, the quantity of fuel contained in the inner space 30 increasingly flows out therefrom through the channels 32 and 31 into the inner chamber 1*a* of the pump housing 1 to permit the contraction of the inner space 30. By such outflow of fuel, the valve element 33 is held seated on the valve seat 34 allowing the channel 32 to open into the inner space 30 only through the opening 33*a* thereof. As a result, the governor sleeve 15 is axially displaced in accordance with the quantity of fuel drained off from the inner space 30 through the opening 33*a* and the channels 31 and 32. The governor sleeve 15 is therefore slow in axial displacement in the leftward direction, i.e. the governor sleeve is relatively insensitive in the leftward displacement.

Upon engine deceleration, the centrifugal weights 14 are swung outwardly causing the governor sleeve 15 to be displaced rightwardly in the drawing. In this instance, as the governor sleeve 15 is increasingly displaced rightwardly, a quantity of fuel flows from the inner chamber 1*a* of the pump housing 1 into the inner space 30 to permit expansion of the inner space. By such inflow of fuel, the valve element 33 is held unseated from the valve seat 34 allowing the channel 32 to open into the inner space 30 through the segment-shaped openings 36 as well as the opening 33*a* of the valve element 33. As a result, the governor sleeve 15 is allowed to move rightwardly in accordance with the quantity of fuel which flows into the inner space 30 through the openings 36 as well as the opening 33*a*. The governor sleeve 15 is thus displaced quite sensitively upon engine deceleration.

In the above, it will be noted that the opening 33*a* and channels 31 and 32 constitute first channel means for providing restricted communication between the inner chamber 1*a* and the inner space 30, while the segment-shaped openings 36 and the channels 31 and 32 constitute second channel means for providing substantially unrestricted communication between the inner chamber 1*a* and the inner space 30, and that valve means comprising the valve element 33, is operable to allow only said first channel means to establish the restricted communication upon displacement of the governor sleeve 15 in the direction to produce contraction of the inner space 30 and to allow at least the second channel means to establish the substantially unrestricted communication upon displacement of the governor sleeve in the direction to produce expansion of the inner space.

By the foregoing, there has been provided a distributor-type fuel injection pump with an improved governor mechanism which relatively quickly responds to the demand for engine deceleration and which relatively slowly responds to the demand for engine acceleration, preventing an acceleration jerk and smoky exhaust.

Figure 4:
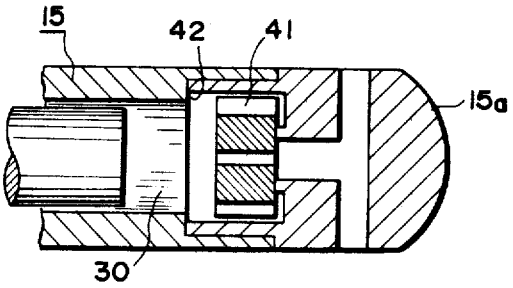
FIG. 4 is a view similar to FIG. 3A but showing another embodiment of the invention.

Referring to FIG. 4, wherein the modified form of the invention is shown, it will be seen that the governor sleeve 15 in this case has a stepped bore to provide a shoulder 42 which is abuttingly engageable with a valve element 41 in the direction away from the valve seat 34. With this arrangement, the transverse pin 35 of the aforementioned embodiment can be dispensed with. Otherwise the action is identical that described in conjunction with FIGS. 3A and 3B.

Figure 5:
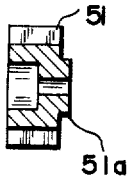
FIG. 5 shows a modified form of a valve element utilized in the governor mechanism of the invention.

Referring to FIG. 5, wherein a modified form of the valve element is shown, it will be seen that a valve element 51 may be provided with an integral valve seat 51*a* so that the valve seat 34 of the aformentioned embodiment is dispensed with.

Figure 6:
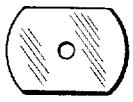
FIGS. 6 and 7 show further modified forms of the valve element.
Figure 7:
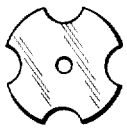

Referring to FIGS. 6 and 7, wherein further modified forms of the valve element are shown, it will be seen that in place of the square shape as in the case of the aforementioned embodiment, the valve element may be formed into various shapes to cooperate with the inner cylindrical wall of the governor sleeve 15 and form a passage or passages of a suitable flow passage cross sectional area so that a desired response characteristic of the governor mechanism is obtained.

Figure 8A:
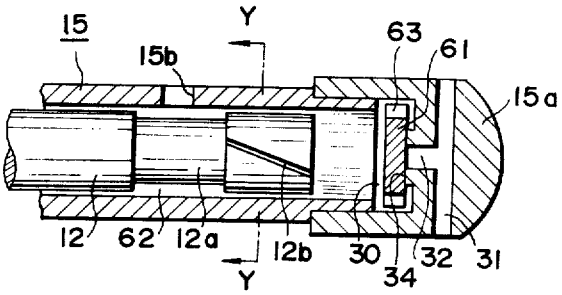
FIG. 8A is a view similar to FIG. 3A but showing a further embodiment of the invention.
Figure 8B:
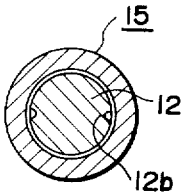
FIG. 8B is a cross sectional view taken approximately along line Y—Y of FIG. 8A.

FIGS. 8A and 8B show a further embodiment of this invention.

In this embodiment, a valve element 61 is not provided with an opening such as opening 33*a* of the valve element 33 of FIGS. 3A and 3B. As an alternative to opening 33*a*, the governor shaft 12 in this case is provided with a reduced diameter neck section 12*a* which cooperates with the inner cylindrical wall of the governor sleeve 15 to define an annular space 62. The end section of the governor sleeve 15 next to the neck section 12*a* on the right-hand side thereof is formed with a groove 12*b* which extends from the inner space 30 to the annular space 62. The governor sleeve 15 is formed with a radial opening 15*b* which establishes communication between the annular space 62 and the inner chamber 1*a* of the housing 1.

With this arrangement, upon engine deceleration, the valve element 61 is held seated on the valve seat 34 closing the channel 32 completely. Thus the outflow of fuel from the inner space 30 takes place only through the passageway comprised of the groove 12*b*, the annular space 62 and the radial opening 15*b*.

Upon engine deceleration, the valve element 61 is moved away from the valve seat 34 and is held against the shoulder (no numeral) which is in this case provided by the end of the governor sleeve proper received in the cap 15*a*. The valve element 61 thus allows inflow of fuel into the inner chamber 30 through two separate fluid flow passageways, one of which is comprised of the channels 31 and 32 and the openings 63 between the inner cylindrical wall of the cap 15*a* and the periphery of the valve element 61 and the other of which is comprised of the groove 12*b*, the annular space 62 and the radial opening 15*b*.

The fluid flow passageway comprised of the groove 12*b*, the annular space 62 and the radial opening 15*b* is constructed so as to produce an effect similar to the first channel means of the aforementioned embodiment. The groove 12*b* may be formed so as to extend in parallel relationship with the axis of the governor shaft 12 but is preferably formed into such a spiral or helical shape that it recedes from an obsever while twisting in the direction opposite to the rotational direction of the governor sleeve 15 which is observed from the end thereof nearer to the inner space 30, that is, in the case where the governor sleeve is constructed to rotate counterclockwise when viewed from the end thereof nearer to the inner space 30, the groove **12*b* is formed into a right-handed helical shape, for the reasons as will be described hereinbelow. Upon counterclockwise rotation of the governor sleeve 15, the right-handed helical groove 12*b* tends to effect a forced fuel conveying action of yielding forceably conveying fuel from the annular space 62 to the inner space 30. Thus, upon engine acceleration, the right-handed helical groove 12*b*** provides an increased or relatively large fluid flow resistance to the outflow of fuel therethrough, while on the other hand upon engine deceleration, it provides a reduced or relatively small fluid flow resistance due to the above mentioned fuel conveying action thereof, thus enhancing the difference in response characteristic between the operation of the governor mechanism upon engine acceleration and engine deceleration.

By the foregoing, there has been provided an improved governor mechanism of a distributor-type fuel injection pump calculated to fulfill the objects hereinabove set forth and while preferred embodiments have been illustrated and described in detail hereinabove, various additions, substitutions, modifications and ommissions may be made thereto without departing from the spirit of the invention as encompassed by the appended claims.

What is claimed is:

1. In a distributor-type fuel injection pump for an internal combustion engine, including:

a pump housing having an inner chamber charged with fuel;

means forming a pump work chamber in communication with said inner chamber;

a distributor plunger adjoining said pump work chamber and delivering a quantity of fuel to said engine for injection during each pressure stroke, said distributor plunger having a relief channel in communication with said pump work chamber;

a control sleeve mounted on said distributor plunger for controlling said relief channel; and a governor mechanism controlling the axial position of said control sleeve to vary said quantity of injected fuel by changing the terminal moment of fuel delivery during each pressure stroke of said distributor plunger, said governor mechanism having a stationary governor shaft, a governor sleeve axially displaceable on said governor shaft and having an inner space adjoined by said governor shaft and in communication with said inner chamber, centrifugal weights mounted for rotation about said governor shaft and mounted to swing outwardly displacing said governor sleeve in the direction to produce expansion of said inner space, and coupling means providing operative connection between said control sleeve and said governor sleeve;

whereby said control sleeve is displaced in the direction to increase said quantity of injected fuel in response to displacement of said governor sleeve in the direction to produce contraction of said inner space;

the improvement therein comprising:

first channel means for providing restricted communication between said inner chamber and said inner space;

second channel means for providing substantially unrestricted communication between said inner chamber and said inner space; and valve means operable for permitting only said first channel means to establish said restricted communication upon displacement of said governor sleeve in the direction to produce contraction of said inner space, and for permitting at least said second channel means to establish said substantially unrestricted communication upon displacement of said governor sleeve in the direction to produce expansion of said inner space.

2. In a distributor-type fuel injection pump for an internal combustion engine, including:

a pump housing having an inner chamber charged with fuel;

means forming a pump work chamber in communication with said inner chamber;

a distributor plunger adjoining said pump work chamber and delivering a quantity of fuel to said engine for injection during each pressure stroke, said distributor plunger having a relief channel in communication with said pump work chamber;

a control sleeve mounted on said distributor plunger for controlling said relief channel; and a governor mechanism controlling the axial position of said control sleeve to vary said quantity of injected fuel by changing the terminal moment of fuel delivery during each pressure stroke of said distributor plunger, said governor mechanism having a stationary governor shaft, a governor sleeve axially displaceable on said governor shaft and having an inner space adjoined by said governor shaft and in communication with said inner chamber, centrifugal weights mounted for rotation about said governor shaft and mounted to swing outwardly displacing said governor sleeve in the direction to produce expansion of said inner space, and coupling means providing operative connection between said control sleeve and said governor sleeve;

whereby said control sleeve is displaced in the direction to increase said quantity of injected fuel in response to displacement of said governor sleeve in the direction to produce contraction of said inner space;

the improvement therein comprising;

first channel means for providing restricted communication between said inner chamber and said inner space;

second channel means for providing substantially unrestricted communication between said inner chamber and said inner space; and valve means operable for permitting only said first channel means to establish said restricted communication upon displacement of said governor sleeve in the direction to produce contraction of said inner space, and for permitting at least said second channel means to establish said substantially unrestricted communication upon displacement of said governor sleeve in the direction to produce expansion of said inner space;

said valve means comprising a valve element which is in the form of a thin, flat plate and which is disposed within said inner space in a manner to be slidingly movable axially of said governor sleeve.

3. In a distributor-type fuel injection pump for an internal combustion engine, including:

a pump housing having an inner chamber charged with fuel;

means forming a pump work chamber in communication with said inner chamber;

a distributor plunger adjoining said pump work chamber and delivering a quantity of fuel to said engine for injection during each pressure stroke, said distributor plunger having a relief channel in communication with said pump work chamber;

a control sleeve mounted on said distributor plunger for controlling said relief channel; and a governor mechanism controlling the axial position of said control sleeve to vary said quantity of injected fuel by changing the terminal moment of fuel delivery during each pressure stroke of said distributor plunger, said governor mechanism having a stationary governor shaft, a governor sleeve axially displaceable on said governor shaft and having an inner space adjoined by said governor shaft and in communication with said inner chamber, centrifugal weights mounted for rotation about said governor shaft and mounted to swing outwardly displacing said governor sleeve in the direction to produce expansion of said inner space, and coupling means providing operative connection between said control sleeve and said governor sleeve;

whereby said control sleeve is displaced in the direction to increase said quantity of injected fuel in response to displacement of said governor sleeve in the direction to produce contraction of said inner space;

the improvement therein comprising;

first channel means for providing restricted communication between said inner chamber and said inner space;

second channel means for providing substantially unrestricted communication between said inner chamber and said inner space; and valve means operable for permitting only said first channel means to establish said restricted communication upon displacement of said governor sleeve in the direction to produce contraction of said inner space, and for permitting at least said second channel means to establish said substantially unrestricted communication upon displacement of said governor sleeve in the direction to produce expansion of said inner space;

said valve means comprising a valve element which has a form other than a solid circular disc having an outer diameter substantially equal to the inner diameter of said governor sleeve, said valve element being disposed within said inner space in a manner to be slidingly movable axially of said governor sleeve.

4. The improvement in a distributor-type fuel injection pump as claimed in claim 2 or 3, in which said valve element is formed with a central opening of a relatively small flow passage cross sectional area, said central opening of said valve element constituting part of said first channel means.

5. The improvement in a distributor-type fuel injection pump as claimed in claim 4, in which said governor sleeve has an inner cylindrical wall for sliding engagement with said valve element, and in which said valve element is so shaped as to cooperate with said inner cylindrical wall of said governor sleeve to define therebetween a plurality of openings the sum of the flow passage cross sectional areas of which are larger than that of said central opening of said valve element and which constitute part of said second channel means.

6. The improvement in a distributor-type fuel injection pump as claimed in claim 2 or 3, in which said valve element is square shaped.

7. The improvement in a distributor-type fuel injection pump as claimed in claim 2 or 3, in which said governor sleeve has a stepped bore to provide a shoulder for limiting the extend of movement of said valve element in one direction.

8. The improvement in a distributor-type fuel injection pump as claimed in claim 2 or 3 in which said governor shaft has a reduced diameter neck section which cooperates with the inner cylindrical wall of said governor sleeve to define therebetween an annular space, said governor shaft having an end section next to said reduced diameter section, said end section having formed in the periphery thereof a groove extending from said annular space and said inner space, said governor sleeve having a radial opening providing communication between said annular space and said inner chamber, and said radial opening, said annular space and said groove constituting said first channel means.

9. The improvement in a distributor-type fuel injection pump as claimed in claim 8, in which said groove is formed into such a helical shape that it recedes from an observer while twisting in the direction opposite to the rotational direction of said governor sleeve which is observed from the end thereof nearer to said inner space.

* * * * *